US006893179B2

(12) United States Patent
Kageyama et al.

(10) Patent No.: US 6,893,179 B2
(45) Date of Patent: May 17, 2005

(54) ROTARY BAR-PROJECTING MECHANISM FOR PUSH-BUTTON IMPLEMENT

(75) Inventors: Hidehei Kageyama, Kawagoe (JP); Yoshio Noguchi, Kawagoe (JP)

(73) Assignee: Kotobuki & Co., Ltd., Kyoto-fu (JP)

( * ) Notice: Subject to any disclaimer, the term of this patent is extended or adjusted under 35 U.S.C. 154(b) by 0 days.

(21) Appl. No.: 10/465,866

(22) Filed: Jun. 20, 2003

(65) Prior Publication Data

US 2004/0213622 A1 Oct. 28, 2004

(30) Foreign Application Priority Data

Apr. 22, 2003 (JP) ..... 2003-116984

(51) Int. Cl.[7] ..... B43K 27/00; B43K 1/10

(52) U.S. Cl. ..... 401/32; 401/258

(58) Field of Search ..... 401/32, 33, 258, 401/259, 260, 111; 200/43.13, 43.18, 523, 526

(56) References Cited

U.S. PATENT DOCUMENTS 2,737,155 A * 3/1956 Berney ..... 401/32
4,904,101 A * 2/1990 Petterson ..... 401/52
5,700,101 A 12/1997 Kageyama et al.

* cited by examiner

*Primary Examiner*—David J. Walczak
(74) *Attorney, Agent, or Firm*—Rothwell, Figg, Ernst & Manbeck

(57) ABSTRACT

A rotary bar-projecting mechanism for a push-button implement comprises: a first bar held axially slidably in a barrel, an operating means capable of making the first bar project from the front end of the barrel when pushed, a tail cap fixed to the barrel and internally provided with a counter rib, a push button capable of being turned relative to the tail cap and provided with a push rib that is aligned with the counter rib of the tail cap when the push button is at a predetermined angular position, and a second bar held in the push button, capable of being projected from the back end of the push button when the push button is turned, and restrained from turning.

9 Claims, 18 Drawing Sheets

ROTARY BAR-PROJECTING MECHANISM FOR PUSH-BUTTON IMPLEMENT

BACKGROUND OF THE INVENTION

1. Field of the Invention

The present invention relates to a rotary bar-projecting mechanism for a push-button implement, such as a writing implement or a cosmetic implement, to project a bar placed in a back part of a barrel included in the push-button implement by rotating the bar.

2. Description of the Related Art

A push button included in a conventional rotary bar-projecting mechanism for a push-button implement of this kind including a barrel and a bar, such as a stylus, is free to move axially in a state where a part of the bar is projected from the front end of the barrel. Therefore, the bar moves axially if a pressure is applied to the push button while the bar is in use and, consequently, it is difficult to use the bar properly. If things come to the worst, the push button is pushed inadvertently and the bar is projected from the front end of the barrel or retracted into the barrel accidentally (Japanese Utility Model Publication No. 5-45514).

SUMMARY OF THE INVENTION

The present invention has been made to solve the foregoing problem and it is therefore an object of the present invention to provide a rotary bar-projecting mechanism for a push-button implement including a barrel, a push button and a bar, such as a stylus, held in a back part of the barrel so as to be projected from the barrel by being turned, capable of preventing the bar from drawing back accidentally into the barrel while the bar is in use, and of preventing an accidental operation of the push button.

Another object of the present invention is to provide a rotary bar-projecting mechanism for a push-button implement, capable of surely projecting a bar by a simple turning operation, and having a cushioning function that absorbs pressure.

According to the present invention, a rotary bar-projecting mechanism for a push-button implement having a barrel, a first bar held axially slidably in the barrel, and an operating means capable of making the first bar project from the front end of the barrel when pushed comprises: a tail cap fixed to a back part of the barrel; a push member capable of being turned and axially moved relative to the tail cap; and a second bar held in the push member, capable of being projected from an end of the push member without being turned when the push member is turned; wherein the tail cap is internally provided with a holding means capable of preventing the retraction of the bar projecting from the end of the push member into the barrel and of keeping the bar projected from the barrel.

BRIEF DESCRIPTION OF THE DRAWINGS

The above and other objects, features and advantages of the present invention will become more apparent from the following description taken in connection with the accompanying drawings, in which.

DETAILED DESCRIPTION OF THE PREFERRED EMBODIMENTS

First Embodiment

Figure 1:
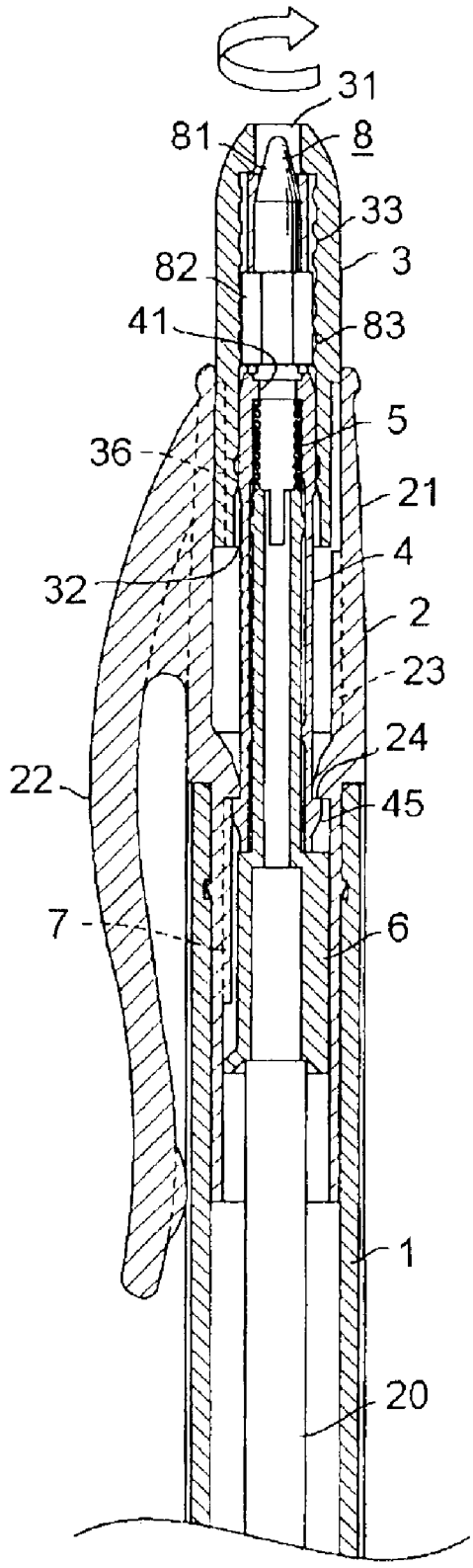
FIG. 1 is a longitudinal sectional view of an essential part of a push-button writing implement provided with a rotary bar-projecting mechanism in a first embodiment according to the present invention.
Figure 2:
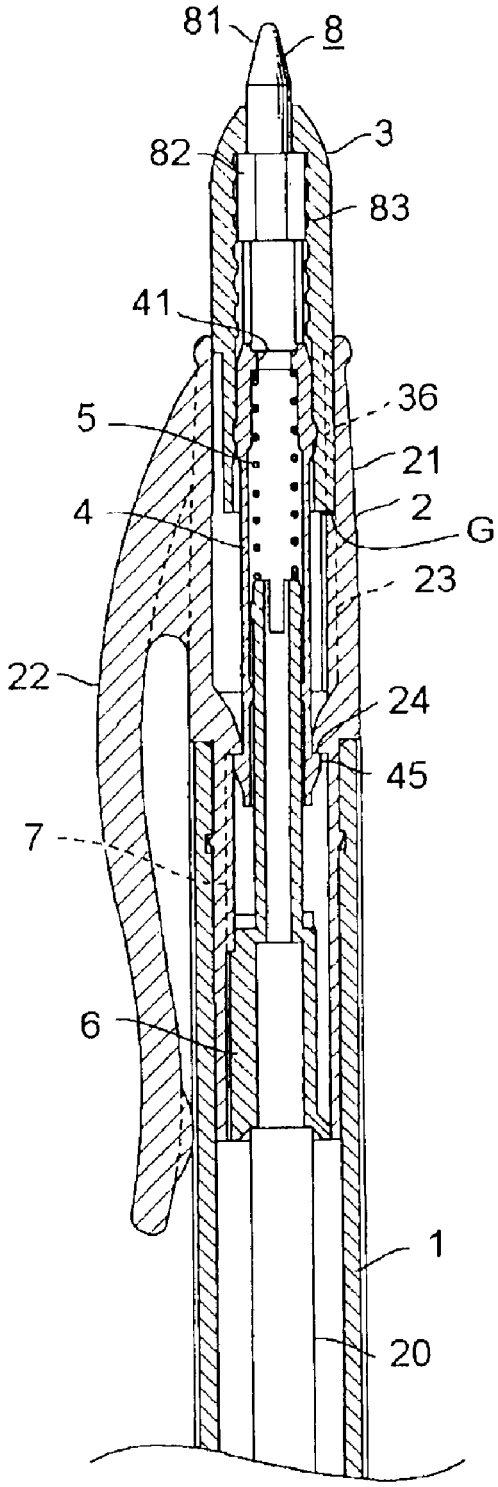
FIG. 2 is a longitudinal sectional view of the essential part of the push-button writing implement shown in FIG. 1 in a state where a bar is projected.

FIGS. 1 and 2 show a rotary bar-projecting mechanism in a first embodiment according to the present invention included in a push-button writing implement in a state where a bar is held inside and a state where the bar is projected outside, respectively. Referring to FIG. 1, a working member 20, such as a ballpoint refill, is held in a barrel 1 so as to be axially slidable. The working member 20 is pushed backward by a comparatively highly resilient return spring, not shown. A tail cap 2 having a hollow cap body 21 and a clip 22 formed integrally with the cap body 21 is fixedly put on a back part of the barrel 1. A holding means such as a longitudinal counter rib 23 is formed on the inner surface of a back part of the cap body 21, and a holding step 24 is formed on the front side of the counter rib 23.

Figure 3:
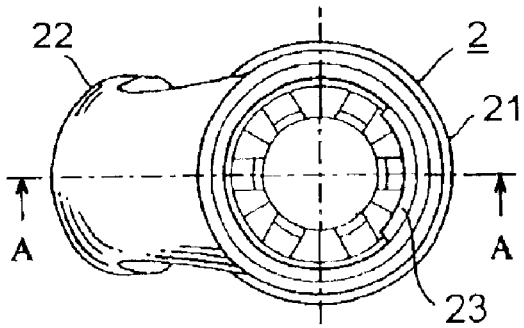
FIG. 3 is an end view of a tail cap with a clip included in the push-button writing implement shown in FIG. 1.
Figure 4:
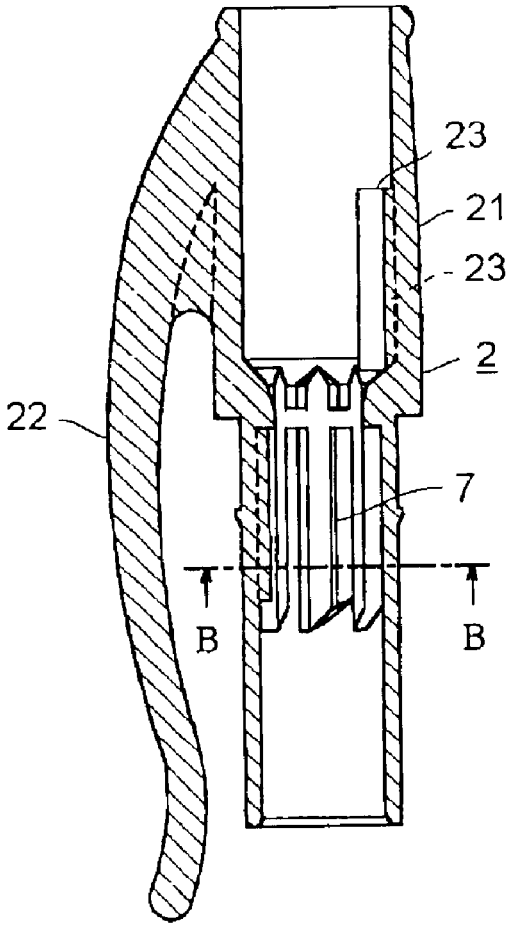
FIG. 4 is a sectional view taken on line A—A in FIG. 3.
Figure 5:
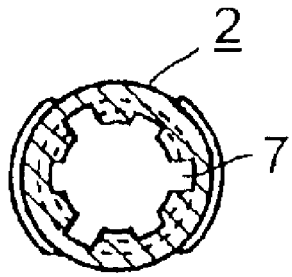
FIG. 5 is a sectional view taken on line B—B in FIG. 4.

Referring to FIGS. 3 to 5 showing the tail cap 2 having the cap body 21 and the clip 22, and provided with the longitudinal counter rib 23 formed on the inner surface of the back part of the cap body 21. Cam grooves 7 are formed in the inner surface of the cap body 21 so as to extend forward from a base part of the counter rib 23.

Figure 6:
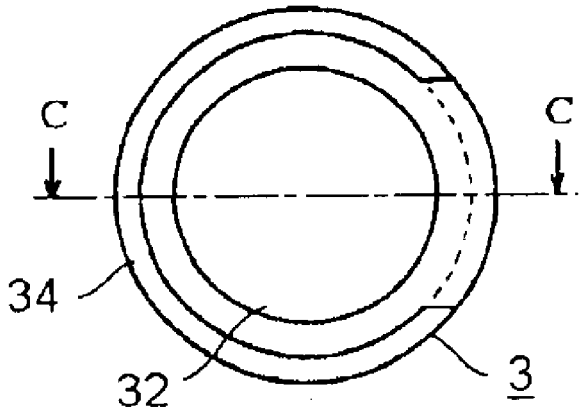
FIG. 6 is a bottom view of a push button shown in FIG. 1.
Figure 7:
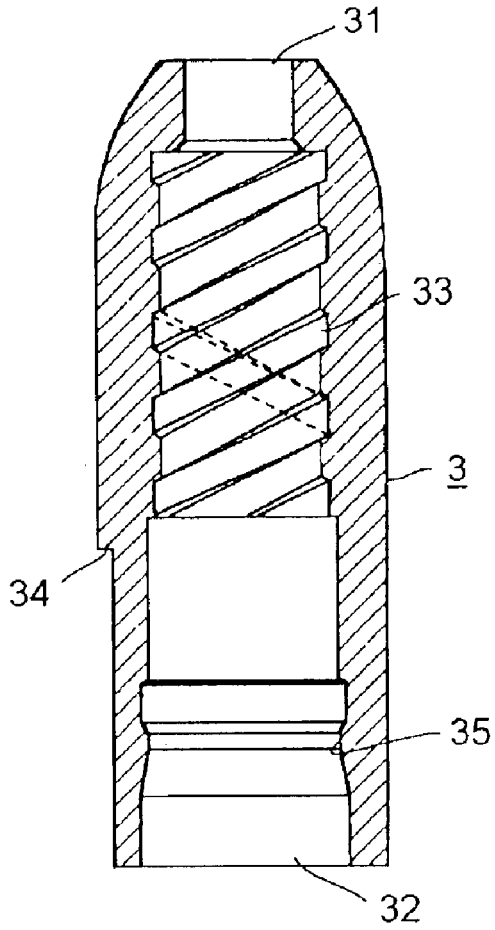
FIG. 7 is a sectional view taken on line C—C in FIG. 6.

Referring to FIGS. 6 and 7, a push button 3 has an open back end 31 and an open front end 32, and is provided with an internal thread 33 formed in its inner surface as best shown in FIG. 7. The push button 3 is fitted in a back part of the tail cap 2 so as to be turnable relative to the tail cap 2 and to surround a stylus 8 having a tip part 81 and a base part 82 of a big diameter provided with projections 83. The projections 83 of the stylus 8 are engaged with the internal thread 33 of the push button 3. The push button 3 is provided with a step 34 on the outer surface of a back part thereof, and an annular protrusion 35 on the inner surface of a front part thereof. A push rib 36 extends backward from the open front 32.

A cam member 4 is combined with the push button 3. The cam member 4 is provided with an inner flange 41 in its middle part. A push spring 5 having a comparatively low resilience is inserted in the cam member 4. A step 45 formed in the outer surface of a front part of the cam member 4 is engaged with the holding step 24 of the tail cap 2. The push spring 5 has one end in contact with one end of a rotary cam 6 to push the rotary cam 6 forward. The rotary cam 6 engages in the cam grooves 7 formed in the inner surface of the tail cap 2.

Figure 8:
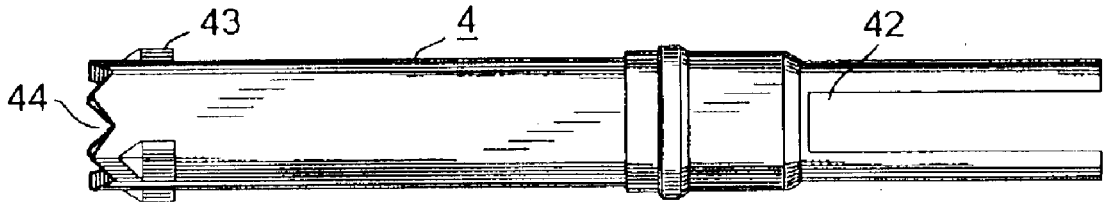
FIG. 8 is a front elevation of a push cam included in the push-button writing implement shown in FIG. 1.

As shown in FIG. 8, a pair of slits 42 are formed diametrically opposite to each other in a back part of the push cam 4. The projections 83 of the stylus 8 project through the slits 42 and engage with the internal thread 31 formed in the inner surface of the push button 3. The push cam 4 is provided with a plurality of protrusions 43 on its outer surface, and a face cam 44 formed in its front end.

Figure 9:
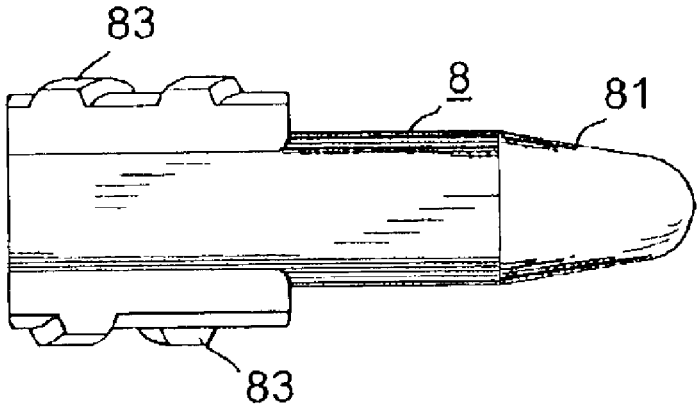
FIG. 9 is a front elevation of a stylus included in the push-button writing implement shown in FIG. 1.
Figure 10:
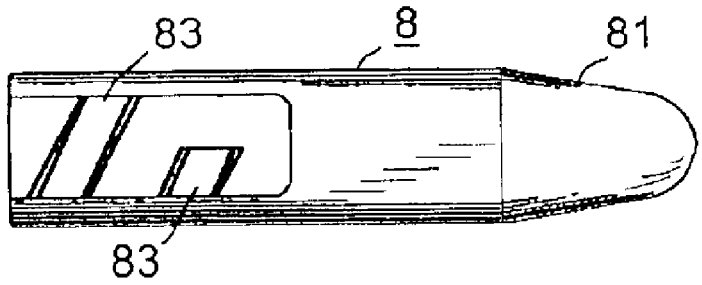
FIG. 10 is a side elevation of the stylus shown in FIG. 9.

Referring to FIGS. 9 and 10, the stylus 8 has a tip part 81 and a base part of a big diameter provided with the projections 83.

The operation of the push-button writing implement provided with the rotary bar-projecting mechanism in the first embodiment will be described. In a state shown in FIG. 1, the push rib 36 of the push button 3 is not aligned with the counter rib 23 of the tail cap 2. The push button 3 is operated to project the tip of the working member 20, i.e., a ballpoint refill, from the front end of the push-button writing implement to use the push-button writing implement for writing. When the push button 3 is depressed against the resilience of the spring, the push cam 4 is moved forward, the working part 61 of the rotary cam 6 in the cam grooves 7 formed in the inner surface of the tail cap 2 to move the tail cap 2 forward, and thereby the working member 20 is advanced and the tip of the working member 20 projects from the front end of the push-button writing implement. Thus, the push-button writing implement is set in a state shown in FIG. 2. The aforesaid cam mechanism retracts the working member 20 into the barrel 1 when the push button 3 is depressed again.

The operation of the rotary bar-projecting mechanism will be described. The push button 3 is turned in the direction of the arrow shown in FIG. 1 with the barrel 1 or the tail cap 2 provided with the clip 22 held fixedly. Then, the projections formed in the outer surface of the base part 82 of the stylus 8, projecting radially outward through the slits 42 of the push cam 4 and engaged with the internal thread 33 formed in the inner surface of the push button 3 are moved backward by the internal thread 33. Thus, the tip part 81 of the stylus 8 projects outside through the open back end 31 of the push button 3 as shown in FIG. 2. In this state shown in FIG. 2, the counter rib 23 of the tail cap 2 and the push rib 36 of the push button 3 are aligned and the corresponding end surfaces of the counter rib 23 and the push rib 36 are joined at least partly. Therefore, the push button 3 is unable to move axially, the stylus 8 is held firmly at a working position, and there is no possibility that the working member 20 is projected or retracted accidentally by the inadvertent operation of the cam mechanism.

The counter rib 23 of the tail cap 2 and the push rib 36 of the push button 3 can be aligned to set the stylus 8 at the working position by limiting the turning of the push button 3 by a stopping means, such as formation of the internal thread in a predetermined range to allow the push button 3 to be turned in a limited angular range.

In using the stylus 8, if a small gap G is formed between the push rib 36 of the push button 3 and the counter rib 23 of the tail cap 2, which are aligned with each other, the stylus 8 can axially be moved for a cushioning action when an excessive pressure is applied to the stylus to absorb the pressure. When the stylus 8 is used for entering information by touching a comparatively fragile input screen, the cushioning action of the stylus 8 is effective in avoiding damaging the input screen.

Second Embodiment

Figure 11:
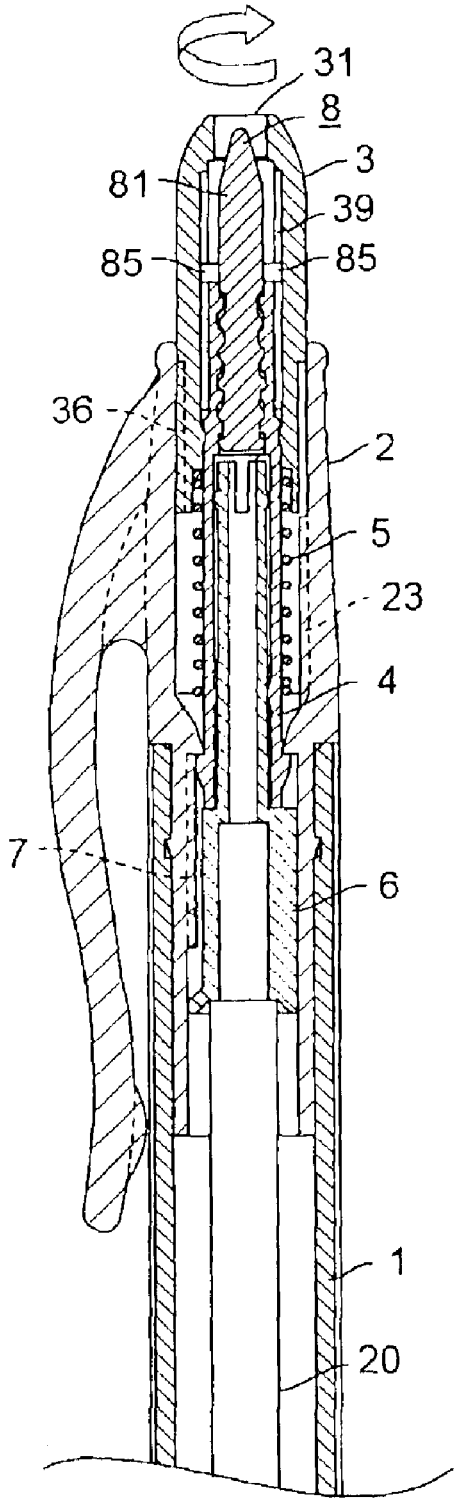
FIG. 11 is a longitudinal sectional view of an essential part of a push-button writing implement provided with a rotary bar-projecting mechanism in a second embodiment according to the present invention.
Figure 12:
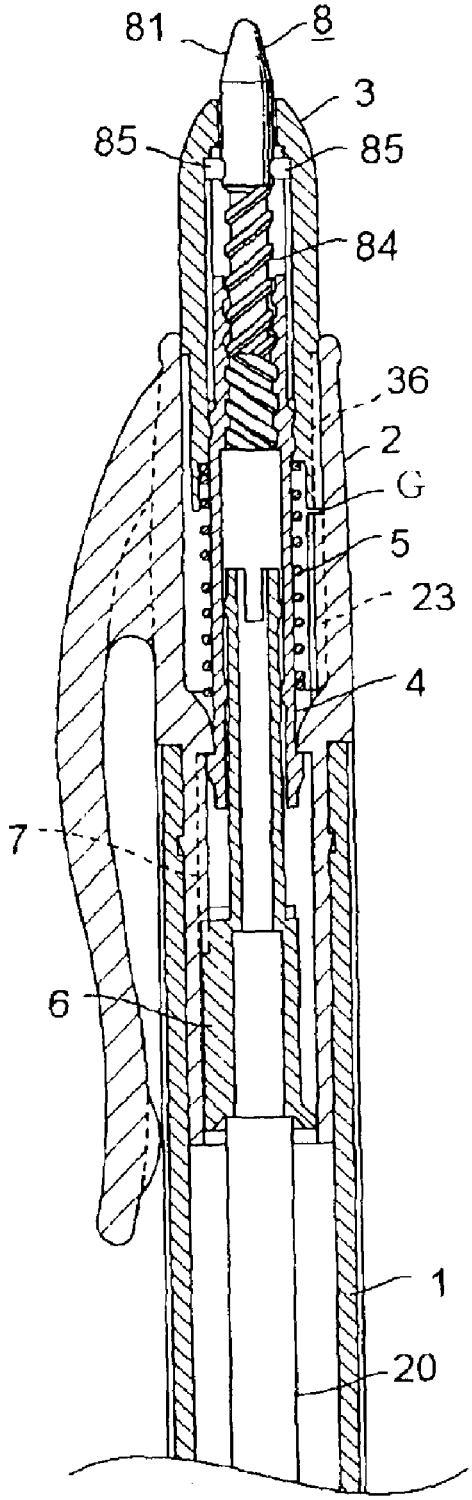
FIG. 12 is a longitudinal sectional view of the essential part of the push-button writing implement shown in FIG. 11 in a state where a bar is projected.

FIGS. 11 and 12 show a rotary bar-projecting mechanism in a second embodiment according to the present invention included in a push-button writing implement. In the second embodiment, an external thread 84 formed on a stylus 8 is engaged with an internal thread formed in the inner surface of a back part of a push cam 4 to move the stylus 8 axially. A push button 3 and the stylus 8 are axially movable. The push button 3 is provided on its inner surface with a stopper rib 39 and the stylus 8 is provided with stopper projections 85 to restrain the push button 3 and the stylus 8 from relative turning. A counter rib 23 and the push rib 36 are aligned in a state where a tip part 81 of the stylus 8 is projected outside through a push button 3, and hence the push button 3 is unable to move back ward even if an excessive pressure is applied to the tip part 81 of the stylus 8. Thus, there is no possibility that a cam mechanism operates accidentally even if the push button 3 is operated inadvertently. The effect of the second embodiment is the same as that of the first embodiment.

Third Embodiment

Figure 13:
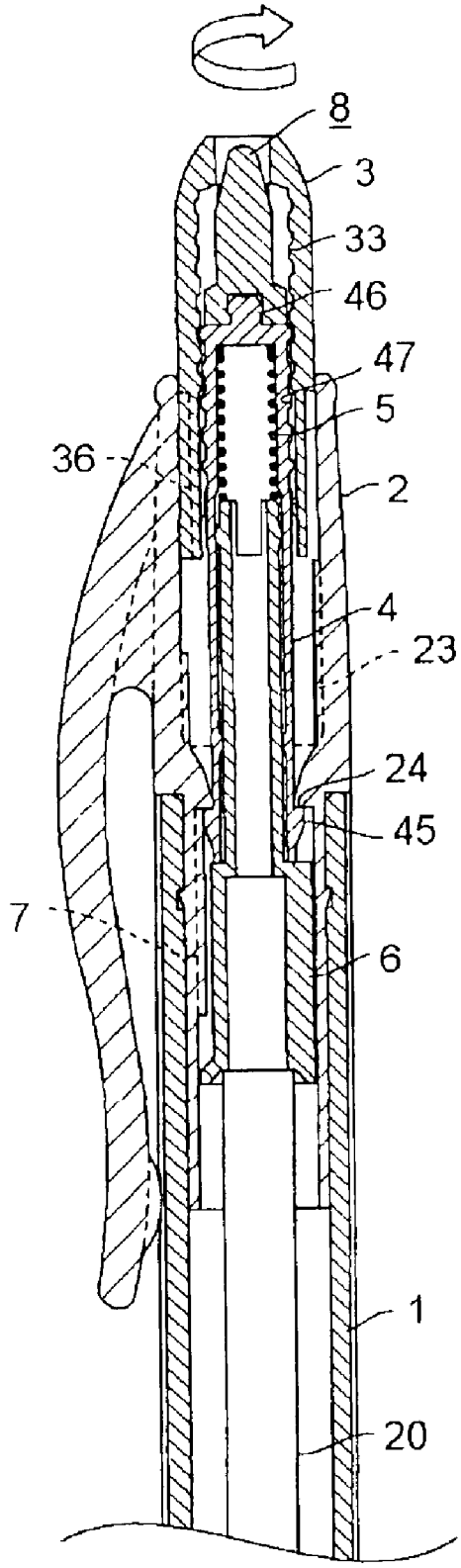
FIG. 13 is a longitudinal sectional view of an essential part of a push-button writing implement provided with a rotary bar-projecting mechanism in a third embodiment according tot the present invention.
Figure 14:
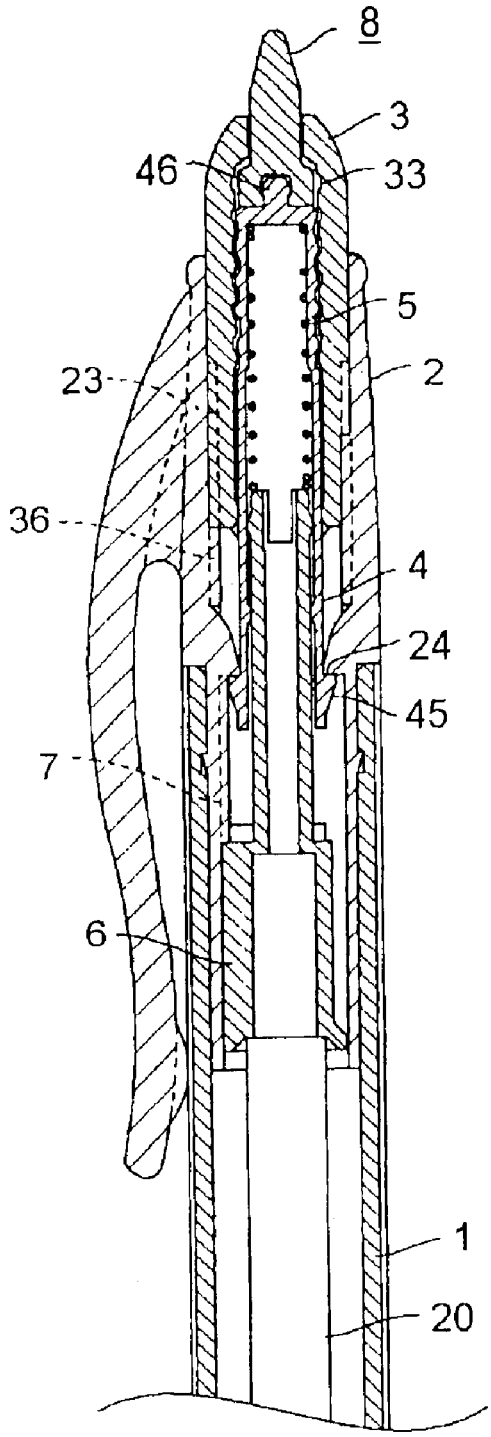
FIG. 14 is a longitudinal sectional view of the essential part of the push-button writing implement shown in FIG. 13 in a state where a bar is projected.

FIGS. 13 and 14 show a bar-projecting mechanism in a third embodiment according to the present invention included in a push-button writing implement. In the third embodiment, a hole is formed in the bottom of a stylus 8, and a projection formed on a push cam 4 is pressed in the hole of the stylus 8. A push spring 5 inserted in the bore of the push cam 4 is in contact with the back end of a rotary cam 6 to push the rotary cam 6 forward. An external thread 47 formed on the outer surface of a back part of the push cam 4 is engaged with an internal thread 33 formed in the inner surface of a push button 3. The push button 3 is moved axially. The stylus 8 connected to the push cam 0.4 by pressing the projection of the push cam 4 into the hole of the stylus 8 is projected outside from the push button 3 by turning the push button 3.

The stylus 8 is held in place, and the push button 3 is turned in the direction of the arrow shown in FIG. 13 relative to a tail cap 2. Consequently, the push button 3 moves axially forward relative to the stylus 8 and a tip part 81 of the stylus 8 is projected from the push button 3. When the push button 3 is turned in the direction of the arrow shown in FIG. 13, the push button moves forward and the tip part 81 of the stylus 8 projects from the upper end of the push button 3 because the internal thread 33 of the push button 3 and the external thread 47 of the push cam 4 are engaged, and a step 45 formed in the outer surface of a front part of the push cam 4 is engaged with a holding step 24 formed on the tail cap 2. As shown in FIG. 14, a counter rib 23 formed on the tail cap 2 and a push rib 36 formed on the push cam 4 are aligned on the left side, as viewed in FIG. 14, of the axis of tail cap 2. The effect of the third embodiment is the same as that of the first embodiment.

Fourth Embodiment

Figure 15:
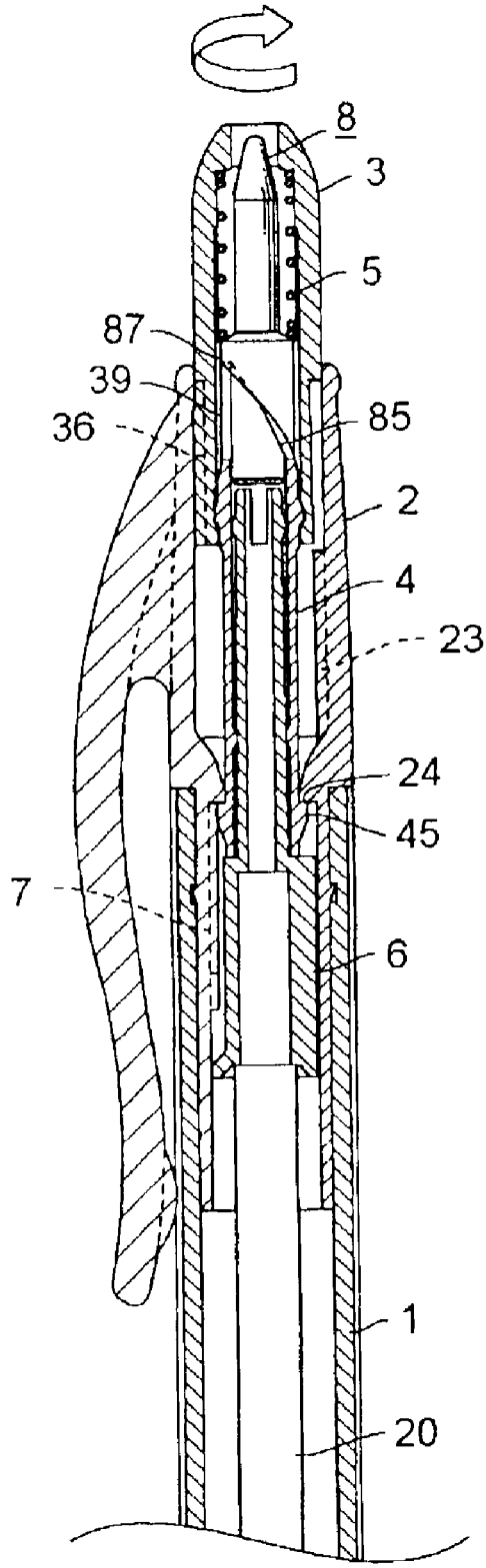
FIG. 15 is a longitudinal sectional view of an essential part of a push-button writing implement provided with a rotary bar-projecting mechanism in a fourth embodiment according to the present invention.
Figure 16:
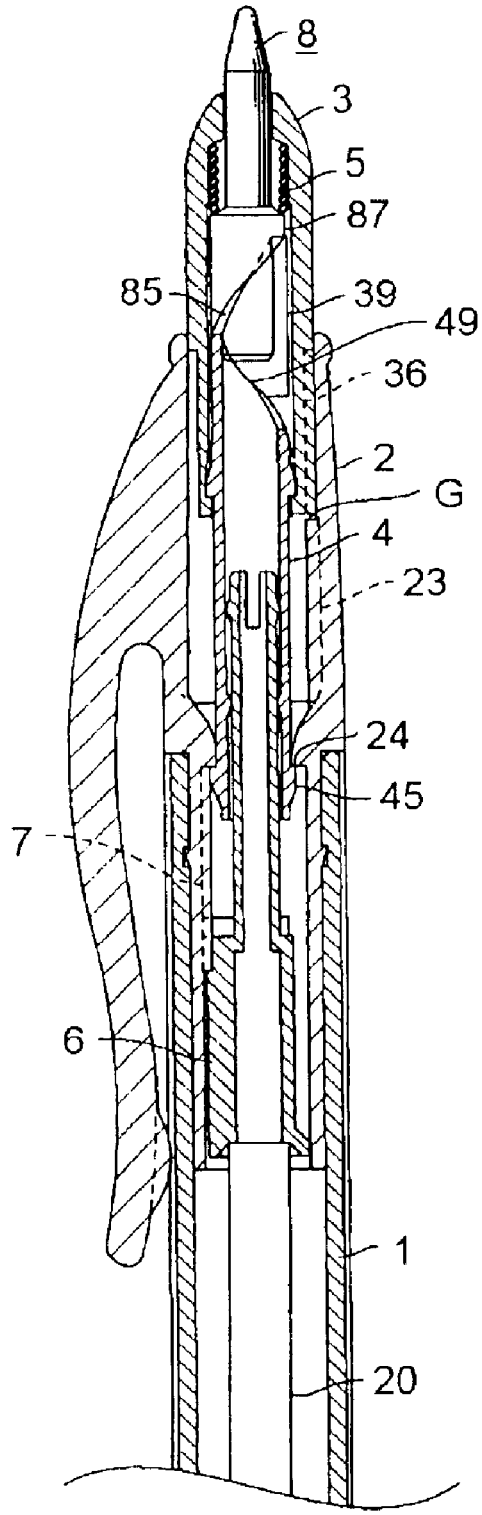
FIG. 16 is a longitudinal sectional view of he essential part of the push-button writing implement shown in FIG. 15 in a state where a bar is projected.

FIGS. 15 and 16 show a rotary bar-projecting mechanism in a fourth embodiment according to the present invention included in a push-button writing implement. A push cam 4 has a bevel back end 49 serving as a cam. A stylus 8 has a bevel end 85 serving as a cam. The bevel back end 49 of the push cam 4 and the bevel end 85 of the stylus 8 are engaged to move the stylus 8 axially. A push button 3 is provided on its inner surface with a stopper rib 39, and the stylus 8 is provided with a projection 87 at a position corresponding to the stopper rib 39. The stopper rib 39 engages with the projection 87 of the stylus 8. thus, the stylus 8 is able to move axially and is unable to turn. When the push button 3 is turned, the stylus 8 is moved axially. The effect of the fourth embodiment is the same as that of the first embodiment.

Fifth Embodiment

Figure 17:
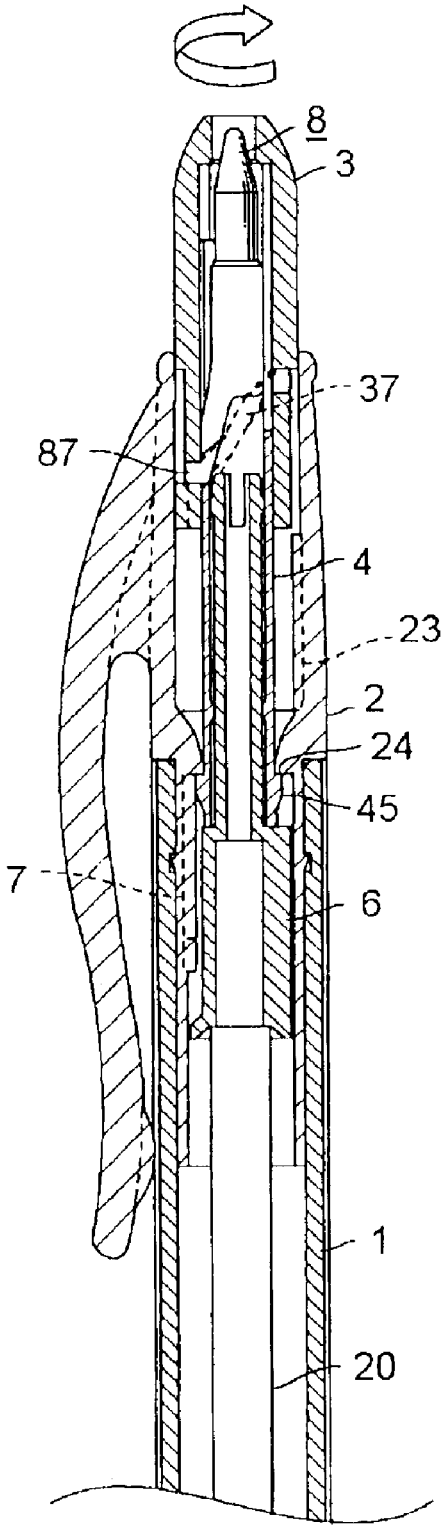
FIG. 17 is a longitudinal sectional view of an essential part of a push-button writing implement provided with a rotary bar-projecting mechanism in a fifth embodiment according to the present invention.
Figure 18:
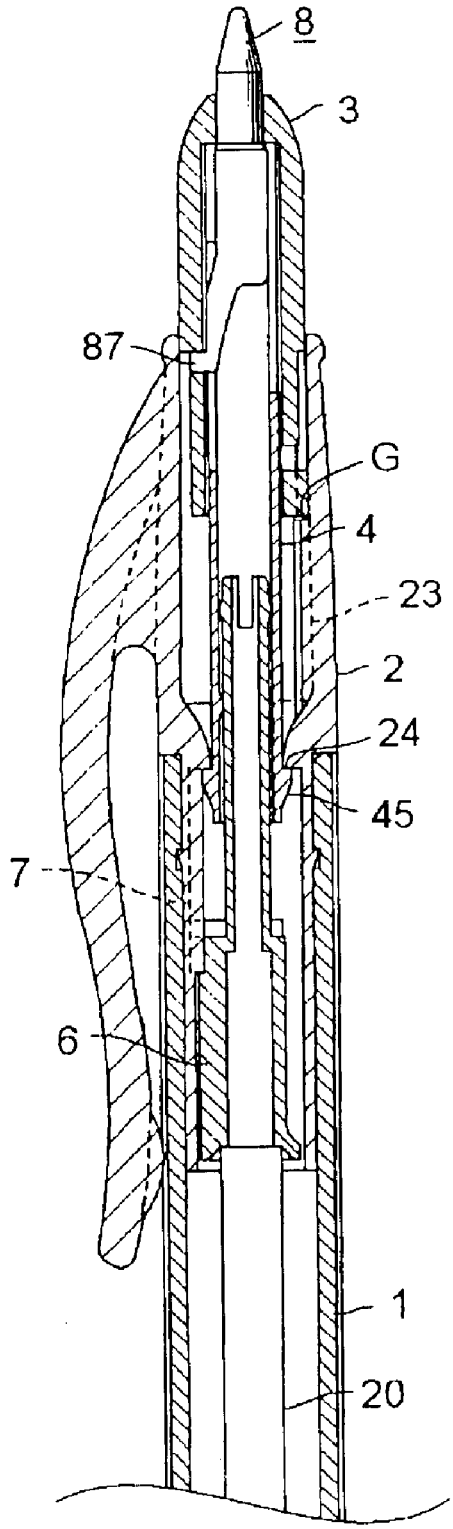
FIG. 18 is a longitudinal sectional view of the essential part of the push-button writing implement shown in FIG. 17 in a state where a bar is projected.

FIGS. 17 and 18 show a rotary bar-projecting mechanism in a fifth embodiment according to the present invention included in a push-button writing implement A push cam 4 is provided with a longitudinal slot 48, and a stylus 8 is provided with a projection 87. The projection 87 is engaged in the slot 48 of the push cam 4 and projects into a cam groove 37 formed in a push button 3. When the push button 3 is turned, the projection 87 slides along the cam groove 37 and thereby the stylus 8 is moved axially. The effect of the fifth embodiment is the same as that of the first embodiment.

Sixth Embodiment

Figure 19:
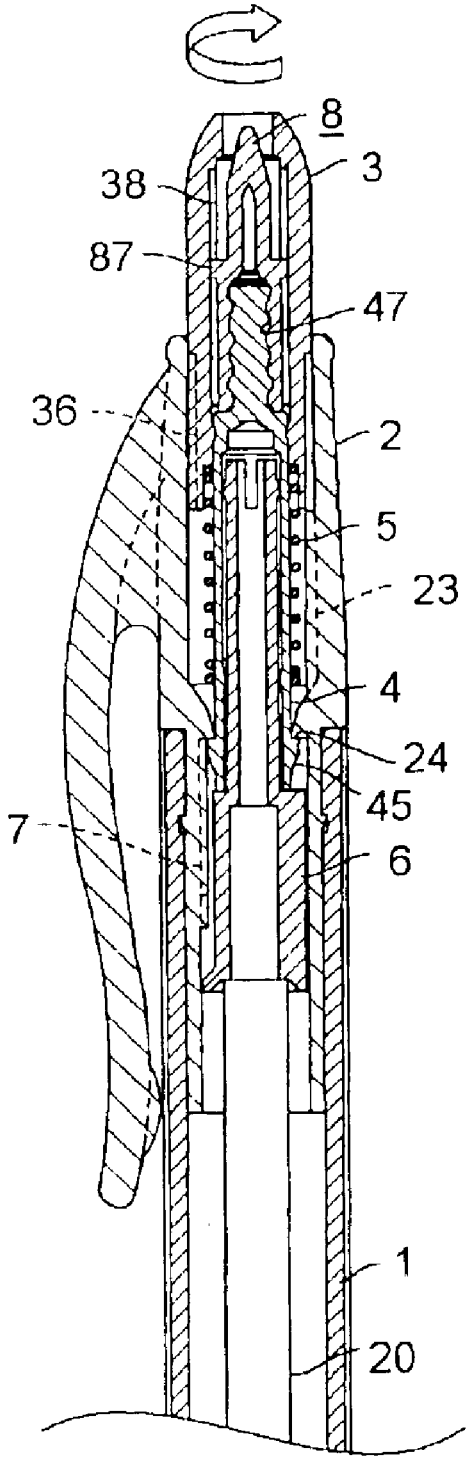
FIG. 19 is a longitudinal sectional view of an essential part of a push-button writing implement provided with a rotary bar-projecting mechanism in a sixth embodiment according to the present invention.
Figure 20:
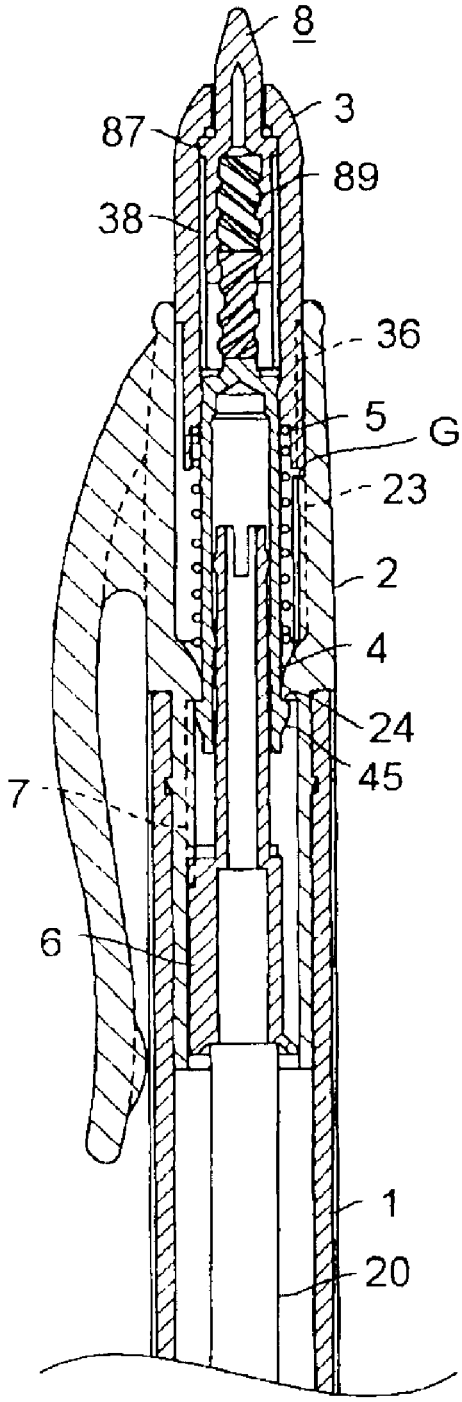
FIG. 20 is a longitudinal sectional view of the essential part of the push-button writing implement shown in FIG. 19 in a state where a bar is projected.

FIGS. 19 and 20 show a rotary bar-projecting mechanism in a sixth embodiment according to the present invention included in a push-button writing implement. A push cam 4 has a back part provided with an external thread 47 on its outer surface. A stylus 8 has a hollow inner part provided with an internal thread 89 on its inner surface, and is provided with projections 87 on its outer surface. The Internal thread 89 and the external thread 47 are engaged, and the projections 87 of the stylus 8 are engaged in guide grooves 38 formed in the inner surface of a push button 3. When the push button 3 is turned in the direction of the arrow shown in FIG. 19, the stylus 8 turns together with the push button 3 relative to the external thread 47 of the back part of the push cam 4 and thereby the stylus 8 is moved axially backward relative to the push button 3 and a tip part of the stylus 8 is projected from the back end of the push button 3. The effect of the sixth embodiment is the same as that of the first embodiment.

Seventh Embodiment

Figure 21:
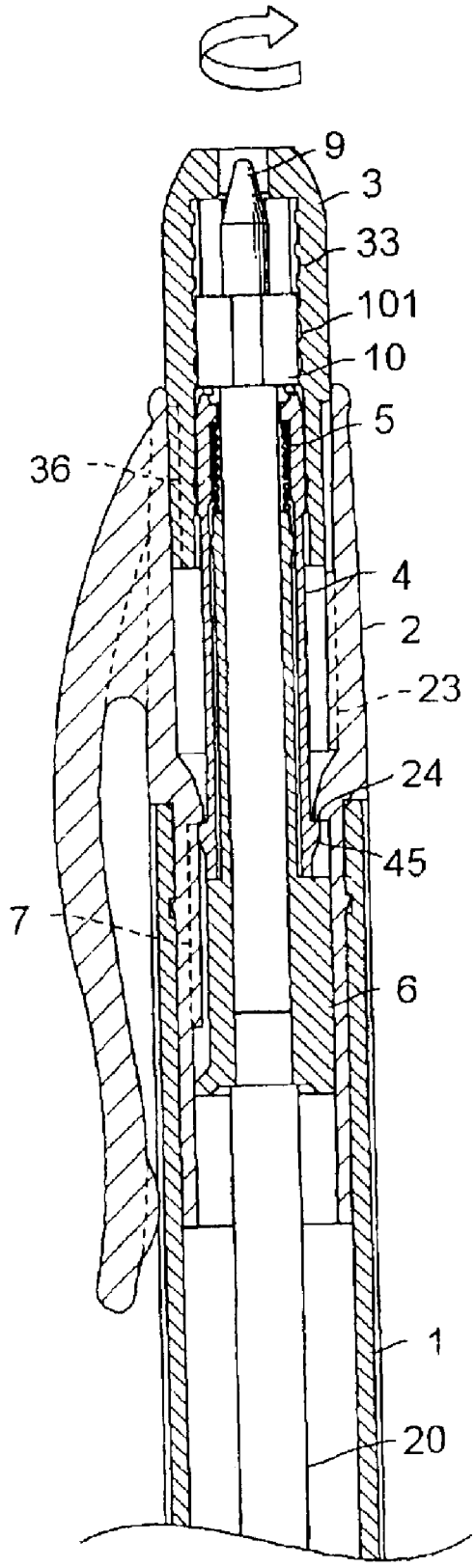
FIG. 21 is a longitudinal sectional view of an essential part of a push-button writing implement provided with a rotary bar-projecting mechanism in a seventh embodiment according to the present invention.
Figure 22:
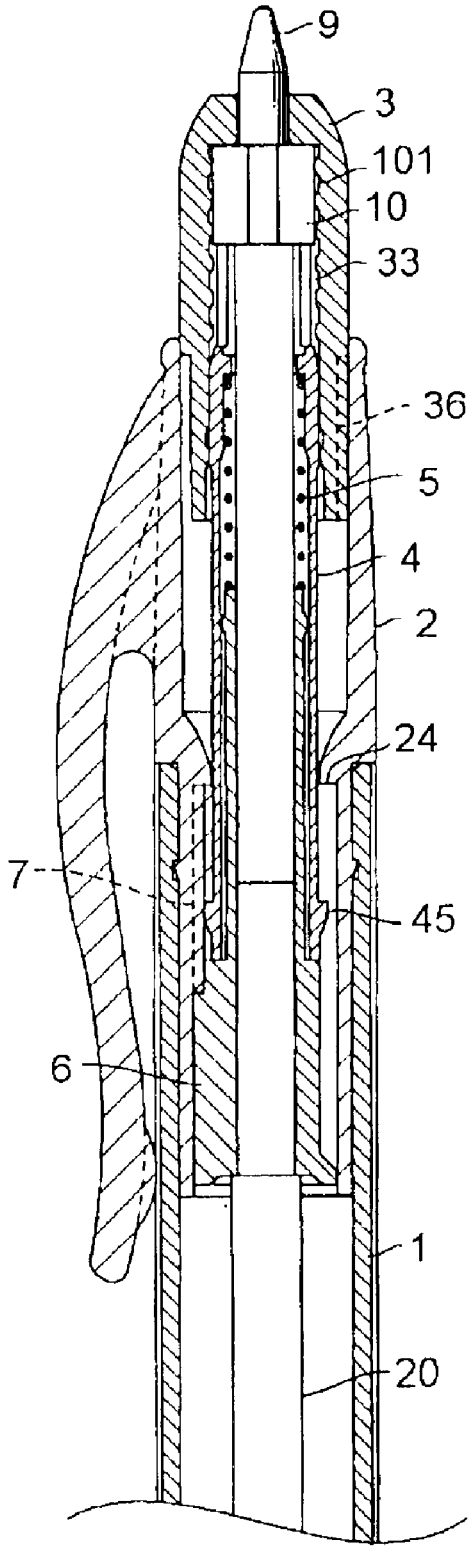
FIG. 22 is a longitudinal sectional view of the essential part of the push-button writing implement shown in FIG. 21 in a state where a bar is projected.

FIGS. 21 and 22 show a rotary bar-projecting mechanism in a seventh embodiment according to the present invention included in a push-button writing implement. This push-button writing implement is substantially the same in construction as that provided with the rotary bar-projecting mechanism in the first embodiment, except that the former push-button writing implement is provided with a refill 9, i.e., a bar other than the stylus, instead of the stylus 8 of the latter push-button writing implement. The refill 9 of a comparatively short length is fixed to a refill holder 10 by pressing a part of the refill 9 in a hole formed in the refill holder 10 or by caulking the refill holder 10 after pressing the refill 9 in a hole formed in the refill holder 10. The refill holder 10 is provided with a plurality of projections 101 on its side surface. The projections 101 are engaged with an internal thread 33 formed in a push button 3. When the rotary bar-projecting mechanism is incorporated into a ball-point pen using an erasable ink, the bar to be projected by the rotary bar-projecting mechanism may be an eraser. The effect of the seventh embodiment is the same as that of the first embodiment.

The push-button implement provided with the rotary bar-projecting mechanism of the present invention is not limited to an writing implement, such as a ballpoint pen, and may be a push-button implement that is provided with an article of stationery, such as a paste bar, a correction bar or an eraser, a bar-shaped cosmetic, such as an eye color stick, or such.

As apparent from the foregoing description, the rotary bar-projecting mechanism of the present invention is capable of holding the projected bar in place even if an excessive pressure is applied to the bar while the bar is in use. The rotary bar-projecting mechanism of the present invention is capable of surely projecting the bar by a simple turning operation, and has a cushioning function that absorbs pressure when an excessive pressure is applied to the bar.

Although the invention has been described in its preferred embodiments with a certain degree of particularity, obviously many changes and variations are possible therein. It is therefore to be understood that the present invention may be practiced otherwise than as specifically described herein without departing from the scope and spirit thereof.

What is claimed is:

1. A rotary bar-projecting mechanism for a push-button implement, wherein a push rib is formed on an outer side surface of a push member, a holding means is a longitudinal counter rib formed on an inner side surface of a tail cap, the counter rib is formed so as to allow the push member to turn, the counter rib is positioned such that an end surface of the push rib and an end surface of the counter rib do not overlap each other in a state where a second bar is retracted into the push member, and the end surface of the push rib and the end surface of the counter rib overlap at least partly each other with a gap formed between those end surfaces to absorb an excessive pressure applied to the second bar in a state where the second bar is projected from the end surface of the push member.

2. The rotary bar-projecting mechanism according to claim 1, wherein the push member is provided in its inner side surface with an internal thread, the second bar has a large part of a big diameter provided on its outer side surface with a fragmentary external thread capable of engaging with the internal thread of the push member, and the second bar is able to move axially and is restrained from turning.

3. The rotary bar-projecting mechanism according to claim 1, wherein the operating means includes a push cam connected to the push member, and a rotary cam capable of turning and engaged in a guided by cam grooves formed in the inner surface of the tail cap, the push cam is provided in its inner side surface with an internal thread, the second bar has a part provided on its outer side surface with a fragmentary external thread capable of engaging with the internal thread of the push member, the push cam is provided in its back end part with slits in which the fragmentary external thread engage, and the second bar is able to slide axially and is restrained from turning.

4. The rotary bar-projecting mechanism according to claim 1, wherein the second bar is provided on its outer side surface with an external thread, a push cam included in the operating means has a back part provided in its inner side surface with an internal thread, the push cam is provided with a projection that engages with a rib formed on the inner side surface of the push member, and the second bar is able to slide axially and is restrained from turning.

5. The rotary bar-projecting mechanism according to claim 1, wherein the second bar has a bottom surface provided with a hole in which a projection formed on a push cam included in the operating means is fitted, the push cam is provided with a fragmentary external thread that engages with an internal thread formed in the push member, and the second bar is able to slide axially and is restrained from turning.

6. The rotary bar-projecting mechanism according to claim 1, wherein the second bar has a large part having a bevel end serving as a cam, a push cam included in the operating means has a bevel back end serving as a cam and engaged with the bevel end of the second bar, a push spring is extended between the push member and the large part of the second bar, and the second bar is able to slide axially and is restrained from turning.

7. The rotary bar-projecting mechanism according to claim 1, wherein the second bar is provided with stopper projections engaged in holes formed in a side wall of the push member, and the second bar is able to slide axially and is restrained from turning.

8. The rotary bar-projecting mechanism according to claim 1, wherein the second bar is a stylus having a hollow base part provided on its inner side surface with an internal thread, a push cam included in the operating means has a back part provided on its outer surface with an external thread that engages with the internal thread of the stylus, and the second bar is able to slide axially and is restrained from turning.

9. The rotary bar-projecting mechanism according to claim 1, wherein the push member is provided in its inner side surface with an internal thread, a refill holder holding the first bar is provided on its outer side surface with a fragmentary external thread that engages with the internal thread of the push member, and the second bar is able to slide axially and is restrained from turning.

* * * * *